United States Patent [19]

Jackson

[11] Patent Number: 4,991,365

[45] Date of Patent: Feb. 12, 1991

[54] FOOT AND LEVELING MECHANISM FOR PANELS IN A RELOCATABLE WALL

[75] Inventor: Francis G. Jackson, Hudsonville, Mich.

[73] Assignee: Harter Corporation, Sturgis, Mich.

[21] Appl. No.: 364,260

[22] Filed: Jun. 9, 1989

[51] Int. Cl.[5] ..... E04H 1/12; A47F 5/10; A47F 11/02

[52] U.S. Cl. ..... 52/126.6; 52/239; 160/135; 160/351

[58] Field of Search ..... 52/126.1, 126.4, 126.6, 52/239, 241, 242, 580; 160/135, 351; 403/338, 336

[56] References Cited

U.S. PATENT DOCUMENTS

| | | | |
|---|---|---|---|
| 3,430,997 | 3/1969 | Propst et al. | 52/239 X |
| 4,100,709 | 7/1978 | Good | 52/239 |
| 4,485,602 | 12/1984 | Flamboe, Jr. et al. | 52/239 |

*Primary Examiner*—Richard E. Chilcot, Jr.
*Assistant Examiner*—Deborah M. Ripley
*Attorney, Agent, or Firm*—Renner, Kenner, Greive, Bobak, Taylor & Weber

[57] ABSTRACT

The present invention is directed to a foot and levelling mechanism (10) for attachment to successive, vertical frame members (13) in a relocatable wall (11). The foot and levelling mechanism (10) includes a first anchor block (50) secured to one of the successive, vertical frame members (13). The first anchor block (50) presents a downwardly directed wedging surface (60). A second anchor block (50) is secured to the vertical frame member (13) other of the successive wall panel assemblies. The second anchor block (50) also presents a downwardly directed wedging surface (60). A leveller housing (30) presents upwardly directed guide surfaces (38 and 39) to engage the wedging surfaces (60) on the first and second anchor blocks (50). An extensible foot assembly (43) extends downwardly from the leveller housing (30). The extensible foot assembly (43) includes a shaft portion (44) with a foot pad (46) attached to the shaft portion (44). The shaft portion (44) is adapted to be protracted and retracted into the leveller housing (30) in order to establish the vertical disposition of the leveller housing (30), and thus the relocatable wall (11) relative to the surface upon which the floor engaging surface (48) of the foot pad (46) rests.

6 Claims, 3 Drawing Sheets

FOOT AND LEVELING MECHANISM FOR PANELS IN A RELOCATABLE WALL

TECHNICAL FIELD

The present invention relates generally to relocatable walls. More particularly, the present invention relates to a mechanism for vertically adjusting the level of successive wall panel assemblies—adjacent and converging—in a relocatable wall.

BACKGROUND OF THE INVENTION

Prior art leveling mechanisms have primarily employed threaded members for vertical adjustment. U.S. Pat. No. 4,100,709 exemplifies the prior art approach for effecting vertical adjustment of a wall. Other commercially available relocatable wall structures have also utilized threaded adjustment members. These prior known structures, however, require that the adjusting device must be threaded into the wall panel prior to erection of that wall panel or prior to the connection of that panel to a successive wall panel. Moreover, the prior known devices are generally capable of adjusting only one wall panel at a time so that considerable tedium is involved when one must adjust two leveling mechanisms simply to effect a height, or leveling, adjustment between two contiguous wall panels.

SUMMARY OF THE INVENTION

It is, therefore, a primary object of the present invention to provide an improved foot and leveling mechanism for a relocatable wall.

It is another object of the present invention to provide an improved foot and leveling mechanism, as above, which is particularly adapted for use in conjunction with wall panel assemblies having vertical frame members that are disposed in opposed relation when the wall panel assemblies are successively disposed in a relocatable wall.

It is a further object of the present invention to provide an improved foot and leveling mechanism, as above, wherein an anchor block is attached to each of the opposed, vertical frame members of the successive wall panel assemblies, and the two anchor blocks on the opposed frame members cooperatively engage a leveller housing in which an extensible foot pad assembly is mounted, thereby permitting adjustment of successive wall panel assemblies by a single mechanism.

It is still another object of the present invention to provide a foot and leveling mechanism, as above, in which the cooperative interaction of the anchor blocks and the leveller housing assists in securing the successive wall panel assemblies together.

It is an even further object of the present invention to provide a foot and leveling mechanism, as above, which is as readily adaptable not only for use in conjunction with successively adjacent, linearly oriented wall panel assemblies but also with an interposed post arrangement to interconnect converging wall panel assemblies.

These and other objects of the invention, as well as the advantages thereof over existing and prior art forms, which will be apparent in view of the following detailed specification, are accomplished by means hereinafter described and claimed.

In genral, a foot and leveling mechanism embodying the concepts of the present invention is particularly adapted for attachment at the juncture of successive members in a relocatable wall. The foot and leveling mechanism employs a first anchor block secured to one of the successive members. The first anchor block presents a downwardly directed wedging surface. A second anchor block is secured to the other of the successive members, and the second anchor block also presents a downwardly directed wedging surface.

The foot and leveling mechanism also utilizes a leveller housing. The leveller housing presents upwardly directed guide surfaces that are configured to engage the wedging surfaces on the first and second anchor blocks and thereby force the first and second anchor blocks into secured juxtaposition. The interaction of the two opposed anchor blocks with the leveller housing also assists in retaining the successive members of a relocatable wall in their juxtaposed position.

An extensible foot assembly extends downwardly form the leveller housing. The extensible foot assembly employs a shaft portion that is adapted to be selectively protracted, and retracted, with respect to the leveller housing, and a foot pad is attached to the lower end of the shaft portion.

One exemplary embodiment of a foot and leveling mechanism, together with certain modified components for special circumstances, are depicted in conjunction with a relocatable wall, are deemed sufficient to effect a full disclosure of the subject invention, are shown by way of example in the accompanying drawings and are described in detail without attempting to show all of the various forms and modifications in which the invention might be embodied; the invention being measured by the appended claims and not by the details of the specification.

DESCRIPTION OF AN EXEMPLARY EMBODIMENT

One representative form of a foot and leveling mechanism embodying the concepts of the present invention is designated generally by the numeral 10 on the accompanying drawings, the foot and leveling mechanism being depicted as it might be incorporated in conjunction with a relocatable wall, designated generally at 11.

Figure 1:
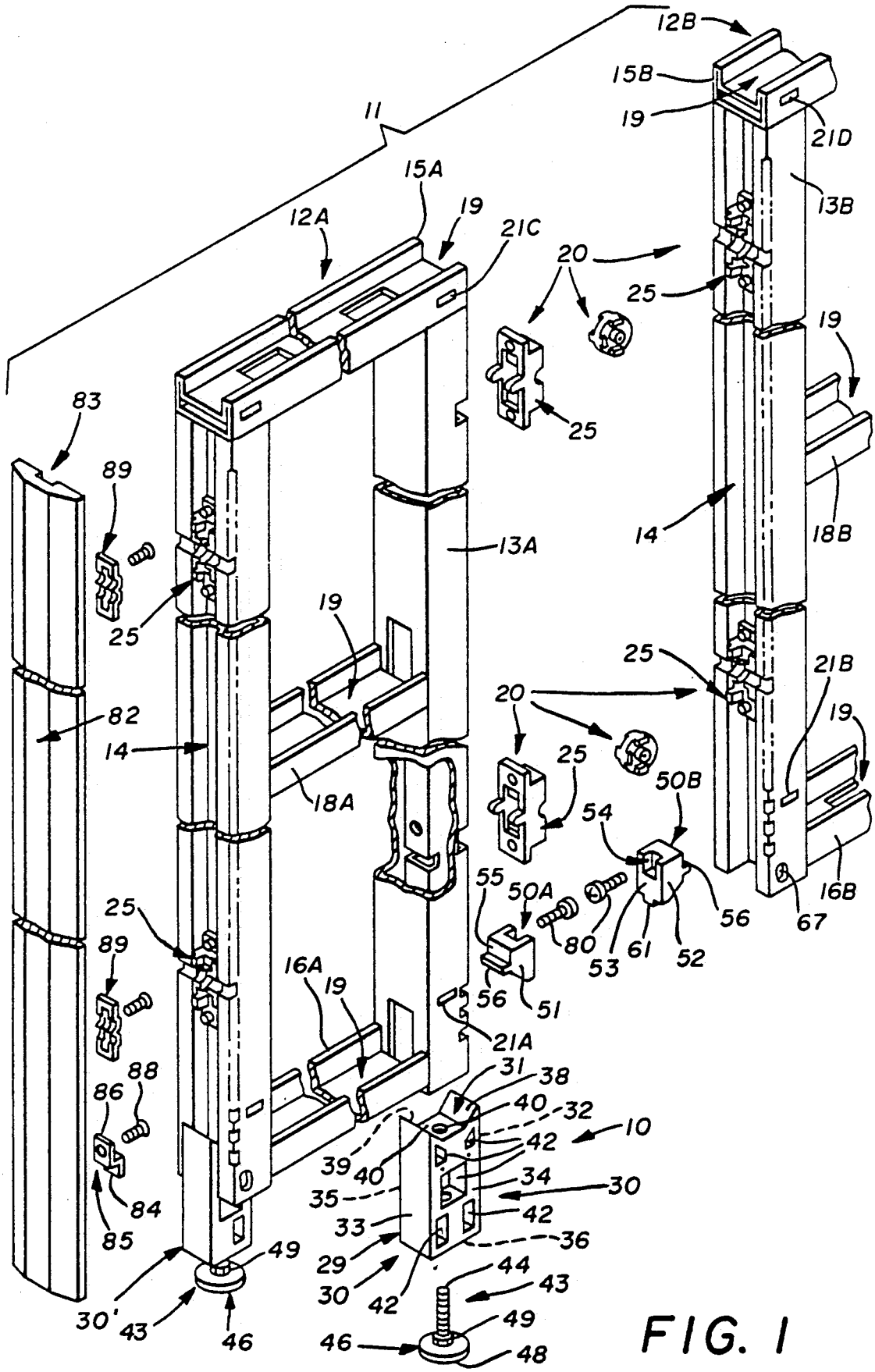
FIG. 1 is an exploded perspective of a relocatable wall structure which incorporates a foot and leveling mechanism embodying the concepts of the present invention.

Referring to the drawings, wherein like characters represent the same or corresponding parts throughout the several views, FIG. 1 depicts an exploded perspective of a representative pair of linearly disposed wall panel assemblies 12A and 12B.

As should become apparent to the reader of the following detailed description, a particular structural member, component or arrangement may be employed at more than one location. When referring generally to that type of structural member, component or arrangment a common numerical designation shall be employed. However, when one of the structural members, components or arrangements so identified is to be individually identified it shall be referenced by virtue of a letter suffix employed in combination with the numerical designation employed for general identification of that structural member, component or arrangment. Thus, there are at least two wall panel assemblies which are generally identified by the numberal 12, but the specific, individual wall panel assemblies are, therefore, identified as 12A and 12B in the specification and on the drawings. This same suffix convention shall be employed throughout the specification.

The wall panel assemblies 12A and 12B have vertical frame members 13A and 13B on the opposed, lateral edges thereof. Each vertical frame member 13 presents an outwardly facing, vertically oriented channel, or groove, 14 which preferably extends the full length of each vertical frame member 13. The vertical frame members 13 in each wall panel assembly 12 are secured to the top, or upper, horizontal frame members 15 as well as to the bottom, or lower, horizontal frame members 16. As best seen in FIG. 1, therefore, the vertical frame member 13A extends vertically between the upper, horizontal frame member 15A and the lower, horizontal frame member 16A in wall panel assembly 12A. Similarly, the vertical frame member 13B extends vertically between the upper, horizontal frame member 15B and the lower, horizontal frame member 16B in wall panel assembly 12B.

It may also be desirable to utilize a horizontally disposed, medial stringer 18 which extend between the vertical frame members 13. As such, a stringer 18A may extend horizontally between the vertical frame members 13A and 13C in wall panel assembly 12A, and a similar medial stringer 18B may be employed in wall panel assembly 12B. The upper frame members 15, the lower frame members 16 and the medial stringers 18 may, as depicted, all incorporate a channel-shaped race 19 which permits the convenient inclusion of electric and telephone lines as well as computer communication cables within the wall panel assemblies of a relocatable wall 11.

Before continuing with a description of the foot and leveling mechanism 10 it should be explained that successive wall panel assemblies 12 may be effectively joined by the use of one or more interconnecting structures 20 which are designed to effect a structurally integrated connection between successive— both linear and converging—wall panel assemblies in a relocatable wall. A more detailed description of a representative interconnecting structure 20 can be found in the copending U.S. Pat. application, Ser. No. 07/364,027, also filed on Jun. 9, 1989, assigned to the assignee hereof and bearing the title "Interconnecting Structure for Releasably Securing Successive Panels in a Relocatable Wall."

Figure 2:
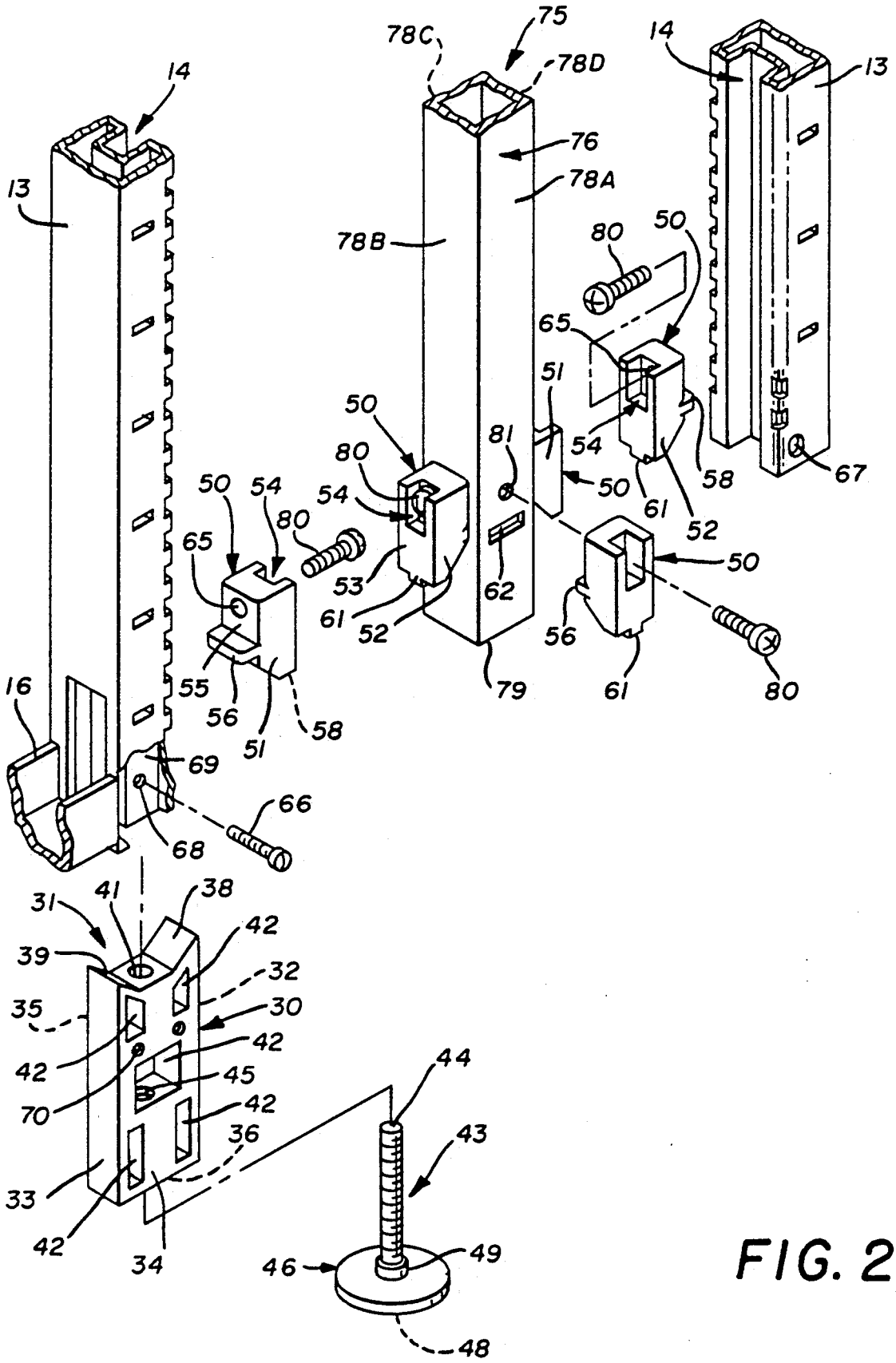
FIG. 2 is an enlarged, exploded perspective similar to, but depicting only a portion of, the relocatable wall structure represented in FIG. 1 and focusing more specifically on the foot and levelling mechanism incorporated in that relocatable wall structure as well as the interposition of a post arrangement to accommodate converging wall panel assemblies as well as linearly oriented wall panel assemblies; and, FIG. 3 is a further enlarged, vertical section through a portion of an assembled, relocatable wall structure to detail the foot and leveling mechanism embodying the concepts of the present invention as that mechanism is employed in conjunction with the opposed vertical frame members of successive wall panel assemblies.

A plurality of anchor slots 21 are spaced along selected structural members, such as the vertical frame members 13 and the upper frame member 15, which delineate the lateral and upper edges of the wall panel assemblies 12. As best seen in FIG. 2, a plurality of anchor slots 21A may be provided in the vertical frame member 13A, a plurality of anchor slots 21B may be similarly provided in vertical frame member 13B and comparable anchor slots 21C and 21D may be provided in the upper frame members 15A and 15B, respectively, of the wall panel assemblies 12A and 12B. The anchor slots 21 are adapted to secure decorative panel coverings (not shown) to the wall panel assemblies 12 in a manner well known to the art. The panel coverings are generally a fabric covered sheet which is removably secured to the frame. The fabric coverings may be added after the panel assemblies are secured together to form the relocatable wall. The fabric coverings can be changed after the wall is assembled for the purposes of redecorating, all as is well known to the art.

The vertical channels 14 are adapted to receive one or more cam key blocks 25, which are important components of the interconnecting structure 20. The vertical channels, as will hereinafter become apparent, are also successfully employed in conjunction with the foot and leveling mechanism 10.

Turning now to a detailed description of the foot and leveling mechanism 10, continued reference to the drawings reveals that the body portion 29 of a leveller housing 30 is substantially a rectangular polyhedron of a generally parallelepiped configuration, except for the hereinafter described receptacle 31 which delineates the upwardly facing portion of the leveller housing 30. Specifically, the body portion 29 is bounded by rectangular front and rear faces 32 and 33, respectively, as well as a pair of rectangular side walls 34 and 35. The lowermost extremity of the body portion is defined by a rectangular base 36, and the uppermost portion of the body portion 29 comprises the upwardly directed receptacle 31. The receptacle 31 is defined by a pair of inclined guide surfaces 38 and 39 which extend divergently upwardly from a bottom surface 40 preferably to intersect with the front and rear surfaces 32 and 33, respectively. As such, the receptacle has the general configuration, in side elevation, of a truncated "V". A locating recess 41 is provided in the center of the bottom surface 40.

The body portion 29 of the leveller housing 30 has a plurality of transverse openings 42 which are included to lighten the leveller housing 30 and to reduce the cost of the material (usually metal) from which the leveller housing 30 is manufactured, but without sacrificing the strength of the housing 30.

An extensible foot assembly 43 is operatively mounted in the leveller housing 30. The extensible foot assembly 43 may conveniently comprise a threaded shaft portion 44 which is received within a threaded bore 45 that extends upwardly through the base 36 and into the body portion 29 of the leveller housing 30 so that selective rotation of the shaft portion 44 will effect protraction, or retraction, of the shaft portion 44 relative to the body portion 29 of the leveller housing 30. The extensible foot assembly 43 also includes a foot pad 46. The foot pad 46 has a flat, floor engaging surface 48, and a tool engaging, hub portion 49. The tool engaging, hub portion 49 is preferably hexagonal and of a standard size to accept a conventional open-ended wrench.

The foot and leveling mechanism 10 also includes a pair of anchor blocks 50. Each anchor block 50 has a pair of lateral side walls 51 and 52, an obverse face 53, including a fastener recess 54, and a rear face 55. A laterally extending, locating protuberance 56 extends rearwardly from the rear face 55. Each anchor block 50 also has a flat base 58 which extends between, and intersects, the obverse face 53 and a wedging surface 60 that is inclined upwardly and rearwardly. A semi-cylindrical pilot 61 extends substantially perpendicularly downwardly from the base 58.

One anchor block 50 is disposed within the vertical groove 14 of each vertical frame member 13. As shown in FIG. 1, therefore, anchor block 50A is received within the vertical groove 14 of frame member 13A, and anchor block 50B is received within the groove 14 of frame member 13B. The vertical location of the anchor block 50 within the respective grooves 14 is determined by inserting the locating protuberance 56 in one of the aligning slots 62 (FIG. 3) selected from the plurality thereof which are provided at predetermined locations along the web wall 63 of each channel 14. The engagement of the locating protuberances 56 within the appropriate aligning slot 62 assures that each anchor block 50 is precisely disposed at the desired vertical location within the channel 14 of each vertical frame member 13, as necessary to assure the proper interaction between anchor blocks 50A and 50B on opposed vertical frame members 13 of successive wall panel assemblies 12, as well as between abuttingly opposed anchor blocks 50A and 50B with a leveller housing 30, as is most clearly depicted in FIG. 3. When the anchor blocks 50 are each properly located in their respective grooves 14, a fastener means 64 may be employed to secure the anchor blocks 50 to their respective frame member 13. In the preferred embodiment the fastener means 64 may comprise threaded devices which extend through the bore 65 which penetrates the anchor block 50 threadably to engage the web wall 63 of the channel groove 14. It should be appreciated, however, that other securing devices, such as rivets, may be employed to secure the anchor blocks 50 within the channels 14 of the vertical frame members 13.

With the anchor blocks 50A and 50B thus secured to their respective frame membrs 13, the opposed wall panel assemblies 12A and 12B can be secured in linear alignment, as with the interconnecting structure 20 described in the aforesaid U.S. Pat. Application Ser. No. 07/364027.

Thereafter, if desired, the leveller housing 30 may be secured to the juncture of the opposedly joined frame members 13A and 13B. However, in practice it is highly likely that the leveller housing 30 will be secured to one of the frame members 13 before the opposed wall panel assemblies 12 are joined together.

In the latter situation the leveller housing 30 may, for example, be attached to the vertical frame member 13A of the wall panel assembly 12A. To effect that connection the leveller housing 30 may be slid upwardly within the groove 14 until the inclined wedging surface 60 on the anchor block 50 engages the guide surface 39 on the leveller housing 30 and the rear face 33 of the leveller housing 30 engages the web wall 63 of the groove 14 in the frame member 13A. When the leveller housing 30 is so positioned it may be secured within the respective groove 14 by a screw 66, pin or other fastener, which penetrates a bore 68 (FIG. 2) in the side wall 69 of the groove 14 to be received within an aligned bore 70 that extends transversely through the body portion 29 of the leveller housing 30. An access aperture 67 is provided in the vertical frame members 13 to permit removably inserting the screw 66, or other fastening device.

With the leveller housing 30 thus secured to the wall panel assembly 12A (FIG. 3) it is relatively convenient to lift, and translate, the wall panel assembly 12B until at least the lower portion of the vertical frame member 13B on the wall panel assembly 12B abuts the opposed frame member 13A on wall panel assembly 12A. With the wall panel assembly 12B lifted, the leveller housing 30 on the frame member 13A of the wall panel assembly 12A will enter the groove 14 in the frame member 13B, and as the wall panel assembly 12B is lowered, the wedging surface 60B on the anchor block 50B will engage the guide surface 38 on the leveller housing 30 to assist in bringing the frame member 13B into abutment with the frame member 13A. The interconnecting structure 20 may then be operated to secure the linear joinder of the wall panel assemblies 12A and 12B. In addition, a second screw 66, or other fastener, may penetrate the side wall of the groove 14 in frame member 13B to be received within a second bore 71 that extends transversely through the body portion 29 of the leveller housing 30.

Figure 3:
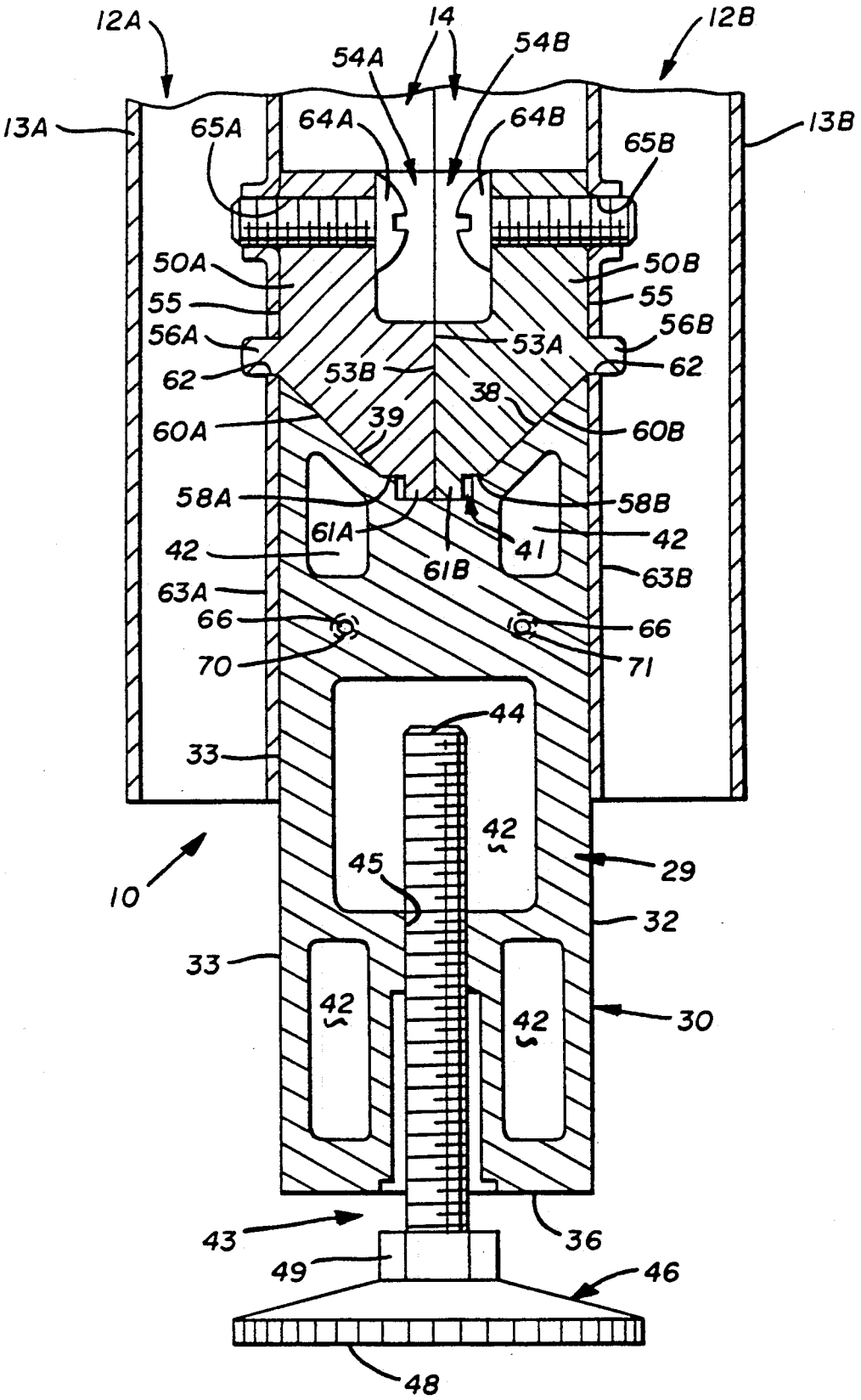

With continued reference to FIG. 3, when the foot and leveling mechanism 10 is so assembled, the angularly downwardly disposed wedging surfaces 60A and 60B on the opposed anchor blocks 50A and 50B, respectively, will abuttingly engage the upwardly and outwardly disposed guide surfaces 39 and 38, respectively, in the receptacle 31 presented in the body portion 29 of the leveller housing 30.

It will be noted that the adjacent pilots 61A and 61B on the abutting anchor blocks 50A and 50B are received within the locating recess 41. the semicylindrical pilots 61 combine, in effect, into a single cylindrical member 73 which has a slightly smaller diameter than that of the locating recess 41. The primary purpose of the depicted engagement of the pilots 61 within the locating recess 41 will be hereinafter fully explained.

The foregoing explanation as to the use of the foot and leveling mechanism 10 has been directed to the use of the foot and leveling mechanism in conjunction with a linear intersection between two successively adjacent wall panel assemblies 12A and 12B that are aligned, and joined, as depicted in FIGS. 1 and 3. It is, however, also comtemplated that the same foot and leveling mechanism 10 can be used in conjunction with a post arrangement 75 employed to join converging wall panel assemblies 12. U.S. Pat. Application Ser. No. 07/364027, previously edentified herein, discloses the use of interconnecting structures 20 to secure L-intersections, T-intersections and X-intersections by the interpositioning of a post arrangement 75. There is no need to repeat herein how the interconnecting structure 20 is used with a post arrangement 75. For the purposes of the present disclosure it is sufficient to explain how an identical post arrangement 75 can incorporate a foot and leveling mechanism 10 embodying the concepts of the present invention.

The post arrangement 75 has a polygonal—depicted as square—post member 76, and the foot and leveling mechanism 10 can be utilized with the post member 76. The post member 76 is also provided with aligning slots 62 that extend transversely across a portion of each face. For the square post member 76 depicted there are four faces 78A, 78B, 78C, 78D. At least one aligning slot 62 is provided through each face 78 at one desired level upwardly from the lower end 79 of the post member 76.

An identical anchor block 50 is secured to each of the faces 78 on the post member 76 to which a wall panel assembly 12 is to be attached. To attach the anchor blocks 50 the locating protuberance 56 on each anchor block 50 is insertably received within the aligning slot 62 on that face 78 to which a wall panel assembly 12 is to be secured, and the anchor blocks 50 are secured to the post member 76 by virture of a fastener means 80 which extends through the bore 65 in the anchor block 50 to be threadably received within a bore 81 in the appropriate face 78 of the square post member 76. An opposing anchor block 50 is seccured in the vertical groove 14 in the frame member 13 on the lateral edge of each wall panel assembly 12 that is to converge upon post arrangement 75.

With a leveller housing 30 secured to the post member 76 on each face 78 to which a wall panel assembly 12 is to be secured, one merely lefts the end of the wall panel assembly 12 to be attached to the post arrangement 75 and allows the wedging surface 60 on the anchor block 50 to engage the appropriate guide surface 38 or 39 in the receptacle 31 of the leveller housing 30.

By assembling the wall panel assembly 12 to a post arrangement 75 upon which a leveller housing 30 has already been secured, the insertion of the leveller housing 30 which has already been secured to the post number 76 into the groove 14 in the vertical frame member 13 of the wall panel assembly 12 will establish immediate lateral stability between the wall panel assembly 12 and the post arrangement 75.

It may, however, be the situation that assembly of a particular wall panel assembly 12 to a post arrangement 75 will require that the leveller housing 30 be first secured to the vertical frame member 13 of the wall panel assembly 12. In that situation there is no coaction between the leveller housing 30 and the post member 76 to provide lateral stability until the opposed components of the interconnecting structure 20 have engaged. To obviate potential problems with initial lateral stability, the pilot 61 on each of the opposed anchor blocks 50 is received within the locating recess 41 in the bottom surface 40 of the receptacle 31, thereby insuring initial lateral stability.

The procedure of connecting one or more wall panel assemblies 12 to a post arrangement 75 can be repeated until all desired wall panel assemblies 12 have been duly secured to the post arrangement.

Irrespective of whether the leveller housing 30 is secured to a post arrangement 75 or to two successive wall panel assemblies 12, the leveller housing 30 permits leveling of the wall 11 after assembly. To level of a pair joined wall panel assemblies 12, the tool engaging hub portion 49 of the extensible foot assembly 43 is engaged by a tool such as a open end wrench. The operator then turns the threaded shaft portion 44 by rotating the tool which engages the hub portion 49. Rotation of the shaft portion 44 in cooperation with the threaded bore 45 causes the shaft portion 44 to protract or retract with respect to the leveller housing 30, thus effecting vertical movement of the leveller housing 30 (and the members to which it is secured) relative to the floor upon which the flat surface 48 of the foot pad 46 rests. Each leveling mechanism 10 can thus be adjusted so that the entire run of the wall will be positioned at the desired vertical location.

If, as shown in FIG. 1, the left edge of the wall panel assembly 12A is to be free standing, a decorative end cap 82 may be used to provide a closure for the groove 14. When a decorative end cap 82 is utilized, the leveller housing 30 is modified slightly. Specifically, the modified leveller housing 30' is of lesser dimension between the front and rear faces 32 and 33, respectively, This accommodation is employed inasmuch as the end cap 82 has a groove 83 of lesser depth than the groove 14 in the vertical frame member 13. Thus, the guide surface 39 can be inclined substantially vertically so that it will accept the first leg 84 of an anchor clip 85 instead of an anchor block 50. Otherwise, the leveller housing 30' is identical to the leveller housing 30.

The anchor clip 85 is essentially a stamped sheet metal component having a pair of offset vertical legs 84 and 86. The leg 86 is secured, as by a fasterner 88, to the bottom of the groove 83 formed in the end cap 82, and the leg 84 is disposed in abutment with the substantially vertical guide surface 39 in the modified leveller housing 30'. The end cap 82 is also secured to the vertical frame member 13 by one or more modified cam key blocks 89 described in copending U.S. Pat. Application, Ser. No. 07/364027.

As should now be apparent, the present invention not only provided an improve foot and leveling mechanism but also accomplishes the other objects of the invention.

I claim:

1. A foot and levelling mechanism for attachment to at least two vertical members in a relocatable wall, said foot and levelling mechanism comprising:

a first anchor block secured to one of said successive members;

said first anchor block presenting a downwardly directed wedging surface;

a second anchor block secured to the other of said successive members;

said second anchor lock also presenting a downwardly directed wedging surface;

a leveller housing;

said leveller housing presenting upwardly directed guide surfaces to engage said wedging surfaces on said first and second anchor blocks;

a foot assembly extending downwardly from said leveller housing;

means to adjust said foot assembly vertically with respect to said leveller housing in order to establish a vertical disposition of the successive members in a relocatable wall.

2. A foot and levelling mechanism, as set forth in claim 1, wherein:

an aligning slot is provided in each successive members of the relocatable wall;

a locating protuberance is presented from each of said anchor blocks; and, said locating protuberances on said anchor blocks are received within said aligning slots on successive vertical members.

3. A foot and levelling mechanism, as set forth in claim 2, wherein:

a pilot extends downwardly from each said anchor block;

a locating recess is provided in said leveller housing to receive said pilots.

4. In combination, a foot and levelling mechanism and successive wall panel assemblies in a relocatable wall, said combination comprising;

a first vertical frame member on a lateral edge of one of said successive wall panel assemblies;

a second vertical frame member on a lateral edge of the other of said successive wall panel assemblies;

a first channel in said first vertical frame members;

a second channel is said second vertical frame member;

said first and second channels being opposed;

a first anchor block secured within said first channel;

said first anchor block presenting a downwardly directed wedging surface;

a second anchor block secured within said second channel;

said second anchor block also presenting a downwardly directed wedging surface;

a leveller housing;

said leveller housing presenting upwardly directed guide surfaces to engage said wedging surfaces on said first and second anchor blocks;

a foot assembly extending downwardly from said leveller housing;

means to adjust said foot assembly vertically with respect to said leveller housing in order to establish a vertical disposition of said opposed vertical frame members on successive wall panel assemblies.

5. A combination, as set forth in claim 4, wherein:

at least one aligning slot is provided in each of said first and second channels;

a locating protuberance is presented from each' of said first and second anchor blocks; and said locating protuberances are received within said respective aligning slots in said first and second channels.

6. A combination, as set forth in claim 5, wherein:

a pilot extends downwardly from each said anchor block;

a locating recess is provided in said leveller housing to receive said pilots.

* * * * *

UNITED STATES PATENT AND TRADEMARK OFFICE

CERTIFICATE OF CORRECTION

PATENT NO. : 4,991,365

DATED : February 12, 1991

INVENTOR(S) : Francis G. Jackson

It is certified that error appears in the above-identified patent and that said Letters Patent is hereby corrected as shown below:

Column 1, line 65, delete the word "genral" and substitute therefor --general--; column 2, line 18, delete the word "form" and substitute therefor --from--.

Column 3, line 14, delete the word "numberal" and substitute therefor --numeral--; line 37, delete the word "extend" and substitute therefor --extends--.

Column 6, line 28, delete the word "the" and substitute therefor --The--; line 44, delete the word "edentified" and substitute therefor --identified--.

Column 7, lines 20-21, delete the word "number" that spans those lines and substitute therefor --member--; line 48, delete "a open" and substitute therefor --an open--.

Column 8, line 8, delete the word "fasterner" and substitute therefor --fastener--; line 17, delete the word "provided" and substitute therefor --provides--; and, in the same line, delete the words "improve" and substitute therefor --improved--.

Column 8, lines 44-45 (Claim 2), delete the word "members" that spans those lines and substitute therefor --member--.

UNITED STATES PATENT AND TRADEMARK OFFICE

CERTIFICATE OF CORRECTION

PATENT NO. : 4,991,365

DATED : February 12, 1991

INVENTOR(S) : Francis G. Jackson

It is certified that error appears in the above-identified patent and that said Letters Patent is hereby corrected as shown below:

Column 8, line 65 delete "is" and substitute therefore --member--.

Signed and Sealed this

Sixth Day of April, 1993

*Attest:*

STEPHEN G. KUNIN

*Attesting Officer*

*Acting Commissioner of Patents and Trademarks*